United States Patent [19]

Elliott

[11] Patent Number: 4,836,777

[45] Date of Patent: Jun. 6, 1989

[54] KILN CARS

[75] Inventor: John Elliott, Stoke-on-Trent, United Kingdom

[73] Assignee: Acme Marls Limited, Stoke-on-Trent, England

[21] Appl. No.: 126,054

[22] Filed: Nov. 27, 1987

[30] Foreign Application Priority Data

Nov. 29, 1986 [GB] United Kingdom ..... 8628597

[51] Int. Cl.[4] ..... F27B 9/26

[52] U.S. Cl. ..... 432/241; 432/243; 432/253; 105/422

[58] Field of Search ..... 432/239, 241, 243, 253; 105/422; 296/1 R

[56] References Cited

U.S. PATENT DOCUMENTS

| | | | |
|---|---|---|---|
| 2,629,917 | 3/1953 | Lovatt | 432/241 |
| 4,300,881 | 11/1981 | Salviati | 432/243 |
| 4,462,798 | 7/1984 | Foster | 432/258 |
| 4,487,579 | 12/1984 | Irwin | 432/253 |
| 4,721,459 | 1/1988 | Fritz | 432/241 |

FOREIGN PATENT DOCUMENTS

| | | | |
|---|---|---|---|
| 2655316 | 6/1978 | Fed. Rep. of Germany | 432/241 |

*Primary Examiner*—Henry C. Yuen

*Attorney, Agent, or Firm*—Cushman, Darby & Cushman

[57] ABSTRACT

A light-weight base structure for a kiln car comprises vertical, pillars (11,12,13) arranged around the periphery of the base with vertical wall plates (20 to 28) supported between adjacent pillars to define a hollow cavity filled with light-weight insulating material (32). A baffle which extends outwardly around the periphery of the base is formed from bats (15 to 19) of generally T-shape in plan, each with an inner portion (15*a* to 19*a*) which extends between the facing sides of adjacent pairs of pillars and an outer portion (15*b* to 19*b*) which extends partially over the outwardly directed sides of the pillars so that such outer portions collectively form an effectively continuous baffle around the base. The peripheral wall is divided by such bats and the wall plates engage in grooves (15*c* to 19*c*) formed in the upper and lower faces of the inner portions of the bats, the bats being substantially balanced on the wall plates on which they rest.

10 Claims, 3 Drawing Sheets

KILN CARS

FIELD OF THE INVENTION

This invention relates to kiln cars of the type employed for carrying articles of ceramic ware through a kiln during a firing process. Such kiln cars normally comprise a non-refractory trolley which supports a refractory structure including a base which protects the trolley and carries the ware to be fired, the latter usually being supported on a refractory superstructure which is built up above the base.

BACKGROUND OF THE INVENTION

To reduce loss of heat due to thermal cycling, it is desirable to minimise the thermal mass of the base, for example as described in our European Patent specification No. 0024037. This shows a kiln car base structure formed from a plurality of upright pillars which are carried by the trolley, the pillars serving to locate and support vertically extending ceramic plates which form a wall around at least the periphery of the base so as to define one or more compartments which contain low thermal capacity insulating material. In this prior construction, the pillars each comprise a plurality of vertically stacked elements of load-bearing, thermally insulating ceramic material, and in order to provide a radiative heat seal around the periphery of the base, horizontally disposed generally flat ceramic bats are mounted between a pair of adjacent pillar elements, and extend peripherally outwardly beyond the pillars and the vertical wall plates. Kiln cars of this kind are described in U.S. Pat. Nos. 4,462,798 and 4,721,459.

A further lightweight base structure is disclosed in our British Pat. No. 2179127 in which the pillars which provide support for vertical wall plates are each formed from a single refractor member and the radiative heat seal is afforded by a generally T-section element which is located with the web thereof extending horizontally between a pair of vertically spaced wall plates which define the outer periphery of the hollow base structure.

Both these arrangements have their disadvantages. Forming the pillars from stacked elements provides less rigid support for the superstructure than might otherwise be the case, and interposing the heat seal bat between such pillar elements requires the bat to be constructed as a load bearing member and experience has shown that in use such bats are prone to fracture adjacent to the pillars. Forming the pillars as single refractory members is advantangeous, but the T-shaped heat seal bat is relatively difficult to manufacture successfully, and it is also difficult to assemble with the vertical wall plates.

SUMMARY OF THE INVENTION

The present invention resides in an improved design of lightweight base comprising a plurality of upright pillars for support on a wheeled metal trolley and with vertically extending ceramic wall plates located between said pillars so as to define the periphery of the base and a laterally projecting baffle around the periphery of the base to form a radiant heat seal, characterised in that said baffle comprises substantially flat horizontally extending ceramic bats provided between adjacent pillars around the periphery of the base, each such bat being located between and supported by said wall plates below and above it.

Preferably, each of said bats is formed with respective grooves to receive the edges of said wall plates, such grooves being so disposed that the bat is substantially evenly balanced about its contact with the wall plates.

In order to form an effectively continuous radiative heat seal along each peripheral side of the base, each of said bats is formed with a lateral extension at its outer edge, such extension being disposed peripherally outwardly of the adjacent pillar. Thus, the bats are generally of T-shape in plan view.

Whilst the wall plates between each pair of adjacent pillars around the periphery of the base may define a single wall, preferably such plates are provided in horizontally spaced pairs to define a hollow, double-wall structure affording inner and outer walls, whereby the interior of the hollow wall structure may be filled with a high temperature refractory insulating material whilst the interior of the base within the inner walls is filled with lower temperature refractory insulating material of lightweight and low thermal mass.

The base may also carry, at its periphery, further panels of refractory insulating material for the purpose of adapting the cross-sectional shape of the base to match the profile of the tunnel in which the kiln car is to travel. Such additional panels may be supported, at least in part, by the heat seal bat.

The base may afford additional radiative heat seals formed by vertically spaced bats in a similar manner.

The invention also resides in a base for a kiln car comprising a plurality of upright pillars for support on a wheeled metal trolley wherein the pillars around the periphery of the base serve to locate between them a plurality of ceramic wall plates, characterised in that said wall plates are disposed in horizontally spaced pairs so as to define inner and outer walls of a hollow, double wall structure which is filled with with a lightweight high temperature refractory insulating material.

DESCRIPTION OF THE PREFERRED EMBODIMENT

The invention will now be described by way of example with reference to the accompanying drawings which illustrate one embodiment of kiln car base in accordance with the invention.

In the accompanying drawings, the trolley is indicated generally at T, and the base structure at B. The trolley is of conventional design and accordingly will not be described further.

The base B is a hollow construction of refractory material which includes a plurality of pillars 11, 12 and 13 which rest on metal strips 31, 30 which are secured to the trolley. The pillars 11, 12 and 13 are located on the strips by means of upwardly projecting spigots which enter into bores formed in the pillars for this purpose. Each pillar 11, 12 and 13, is formed with a through-extending rectangular section aperture **14*a* to receive the lower end of a vertically extending post 14** which forms a part of the superstructure (not otherwise shown) on which ware is supported.

Figure 5:
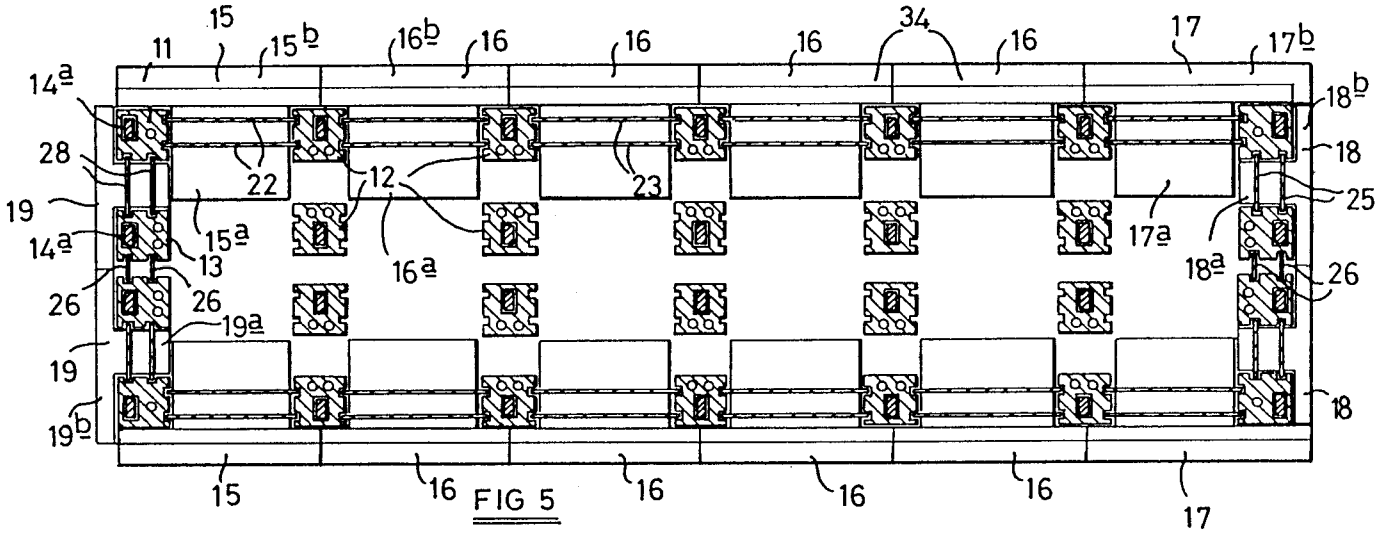
FIGS. 5 and 6 are respectively horizontal sections on the lines A—A and B—B of Figure.
Figure 6:
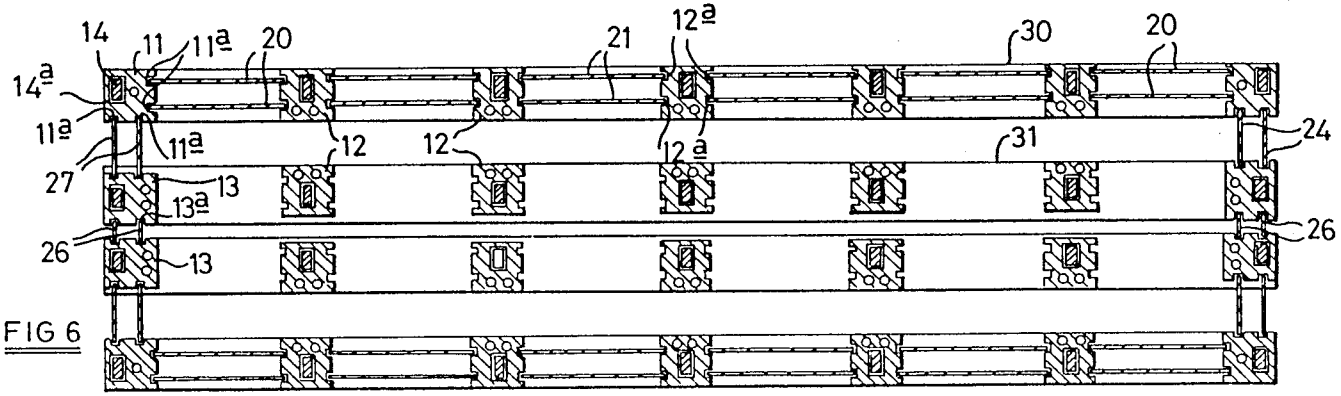

The pillars 11 which are disposed at the corners of the base are formed with two pairs of vertically extending grooves 11*a* in adjacent faces thereof, as most clearly seen in FIGS. 5 and 6. The remaining pillars 12 and 13 are formed with two pairs of similar vertically extending grooves 12*a*, 13*a* in opposed faces thereof. These grooves locate and support a plurality of vertically disposed ceramic baffles or wall plates 20 to 28 which collectively form a double-wall structure around the periphery of the base. The space between the pairs of wall plates is filled with a lightweight, high temperature ceramic insulation material 32. The interior of the base is filled with a lightweight, lower temperature ceramic insulation material 33, covered by a top layer of the high temperature material 32*a*.

Figure 1:
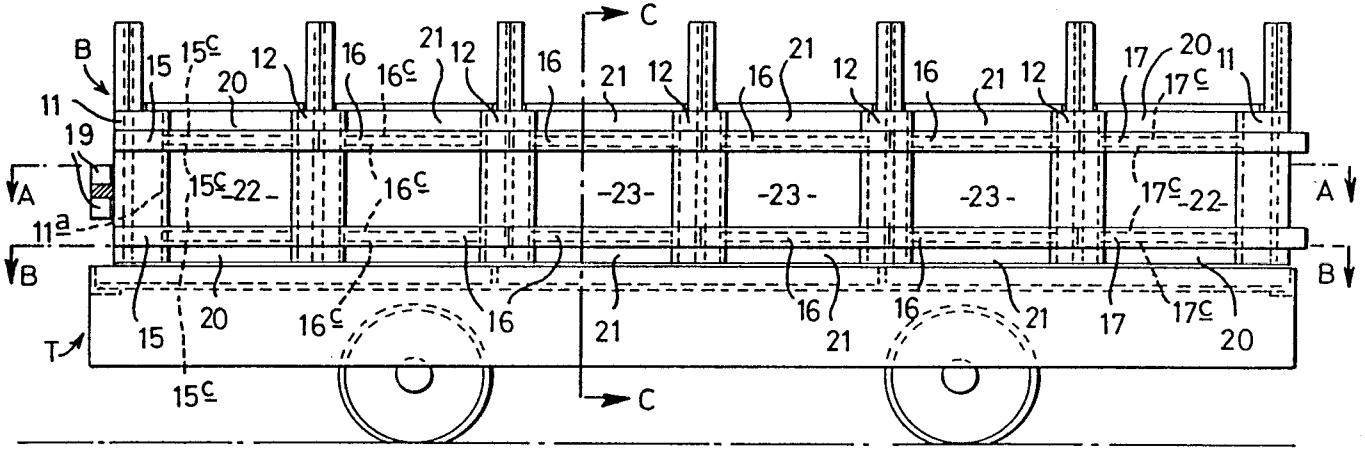
FIG. 1 is a side view showing the base mounted on a trolley, but omitting the ware-carrying superstructure which would be carried by the base.

As can be seen most clearly fron FIG. 1, the portion of the wall between each pair of pillars 11,12 or 12,12 along the length of each lateral side of the base is formed of three such wall plates 20,22,20 or 21,23,21 which are separated in the vertical direction by pairs of horizontally extending ceramic bats 15 to 17. As seen most clearly from FIG. 5, each of such bats is of generally T-shape in plan view, comprising an inner portion 15*a*, 16*a*, 17*a* which extends between the mutually facing sides of an adjacent pair of pillars, and an outer portion 15*b*, 16*b*, 17*b* of greater width which extends partially over the outwardly directed faces of the pillars so that each bat is designed to fit around the pillars so as collectively to form a substantially continuous lateral projection which acts as a baffle or radiant heat seal to prevent the downward transmission of heat from the interior of the tunnel past the sides of the base towards the non-refractory trolley and the rails (not shown) on which it runs.

Figure 3:
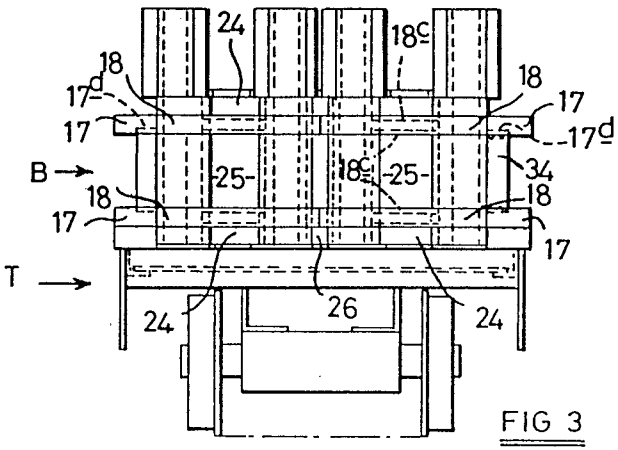
Figure 4:
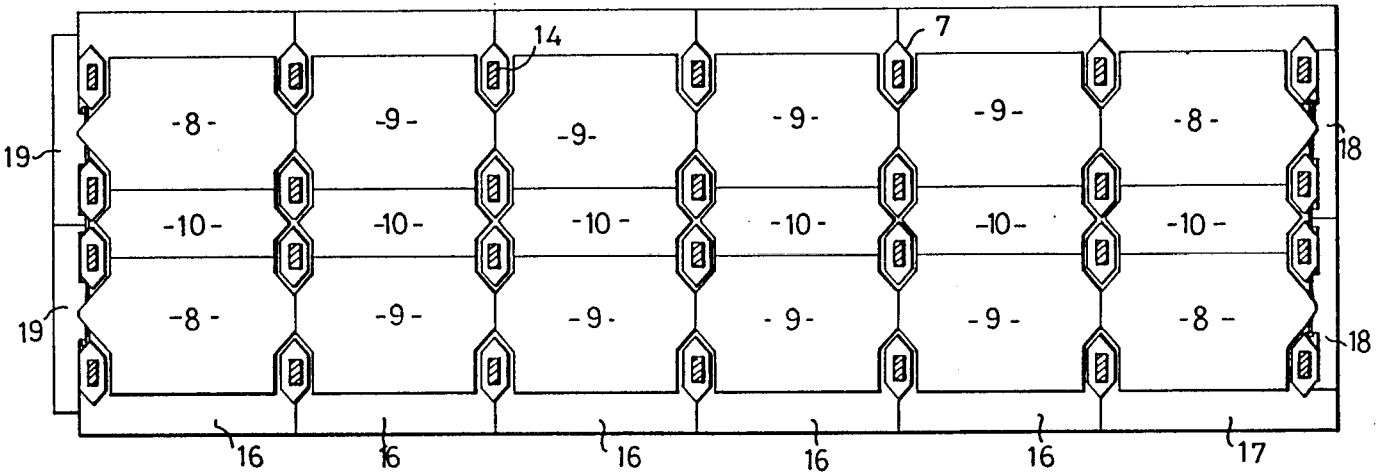
FIG. 4 is a corresponding plan view.

At one transverse end of the base, as shown in FIG. 3, pairs of similar bats 18 with inner and outer portions 18*a*, 18*b* are disposed at the same levels as the bats 15, 16, 17 to form extensions of the heat seals across the end of the kiln car, the bats being disposed between plates 24, 25, 24 which form the end wall.

Figure 2:
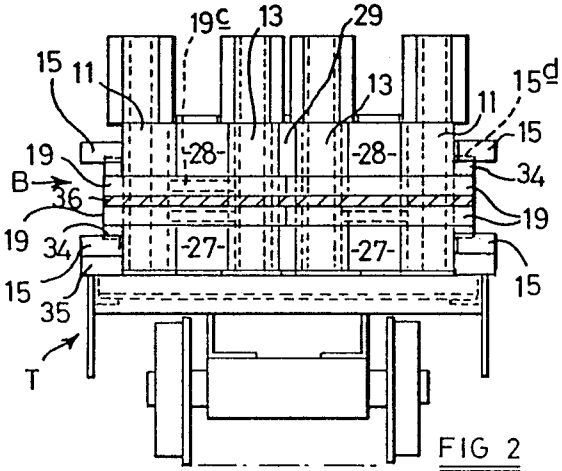
FIGS. 2 and 3 are corresponding opposed end views.

At the opposite end of the kiln car, as shown in FIG. 2, similar bats 19 with inner and outer portions 19*a*, 19*b* are disposed closer together, but spaced by a piece of refractory fibre board 36, at this end of the kiln car the portion of the wall between each pair of pillars 11, 13 being formed of two sections defined by pairs of wall plates 27, 28 as shown in FIG. 2.

In the embodiment illustrated, the short walled portions between adjacent pillars 13 at the ends of the kiln car is formed by pairs of undivided vertical plates 26, the outer portions 18*b* or 19*b* of the heat seal bats being sufficiently extended beyond the pillars 13 to meet one another.

It will be noted that the heat seal formed by bats 19 at the latter end of the kiln car are so dimensioned and disposed as to fit between the heat seal bats 18 at the first-mentioned end of an adjacent similar kiln car.

The heat seal bats 15 to 19 are each formed with a pair of parallel grooves 15*c* to 19*c* running across the upper and lower faces of the inner portions thereof to receive edge portions of the wall plates which they engage.

Figure 7:
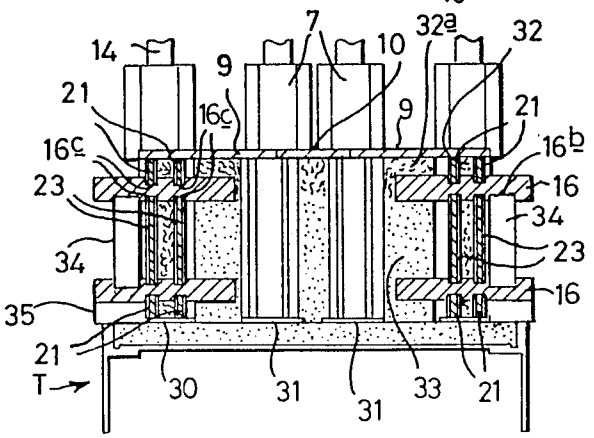
FIG. 7 is a vertical section on the line C—C of FIG. 1.

As can be seen most clearly from FIGS. 5 and 7, each bat is substantially balanced on the wall on which it rests.

The top of the base is closed by a plurality of cover bats 8, 9 and 10 which rest on the upper edges of the uppermost wall plates 20, 21, 24 and 28. The cover bats 8, 9 and 10 are shaped to afford cut-outs at their corners to accommodate refractory tubes 7 which rest on the upper ends of the pillars 11, 12 and 13 and support the posts 14 where they emerge from the base. The posts 14 extend for the full height of the kiln car and at their upper ends carry top bats which hold them in position. Between the tube 7 and the top bats, each post carries a plurality of alternate spacers and shelf-support members whereby ceramic shelves carrying the ware to be fired can be supported from the posts, as described for example in British Pat. No. 2179127 previously mentioned.

The heat seal bats may also be formed with further grooves such as 15*d*, 16*d*, 17*d* as required to locate ceramic fibre board panels 34 between them along the sides of the base to adapt the cross-sectional shape of the base more closely to the profile of the kiln tunnel in which it is to be used. Likewise, further fibre board panels 35 may be interposed between the lower bats 15, 16 and 17 and the trolley T.

Whilst, in the illustrated embodiment, the base B includes two spaced heat seals along its longitudinal sides, it will be appreciated that in some cases there may be only one such heat seal, and in other cases there may be more than two, the side wall being divided into the appropriate number of vertically spaced sections.

Likewise, whilst it is particularly preferred to utilise a double-wall structure in accordance with the invention, in some instances the side walls of the base may be of single thickness only.

Further, whilst in the illustrated embodiment all the heat seal bats 15 to 19 are of generally T-shape in plan it will be appreciated that in some cases other arrangements could be employed. For example, these bats could be of generally L-shape so that the outer portion of each extends fully across the outer face of a single respective pillar, or the outer portion of certain bats could extend fully across the outer face of the two pillars it is arranged between, the adjacent bats being of plain rectangular shape. Also, particularly across the ends of the base, the bats could be shaped to extend around several pillars, with a continuous outer portion carrying two or more inner portions.

I claim:

1. A light weight refractory base for a kiln car having a plurality of upright pillars supported on a wheeled metal trolley, said refractory base comprising:

a plurality of vertically extending wall plates disposed between said pillars thereby defining a periphery of said base;

said refractory base further comprising a laterally projecting radiant heat seal baffle disposed around said periphery;

said baffle comprising a plurality of substantially flat, horizontally extending ceramic bats, said bats provided between adjacent pairs of said pillars; and said wall plates supporting said bats.

2. A base according to claim 1 wherein each of said bats is formed with respective grooves in which the edges of said wall plates are received.

3. A base according to claim 2 wherein each bat is substantially evenly balanced where it engages said wall plates.

4. A base according to claim 3 wherein each bat comprises an inner portion which extends between the mutually facing sides of adjacent pairs of said pillars and an outer portion which extends partially over outwardly directed sides of adjacent pairs of said pillars so that said outer portions collectively form an effectively continuous baffle extending around said base.

5. A base according to claim 1 wherein said wall plates are provided in horizontally spaced apart pairs between adjacent pairs disposed of said pillars to define a hollow, double-wall structure affording inner and outer walls.

6. A base according to claim 5 wherein the interior of the hollow, double wall structure is filled with a high temperature refractory insulating material.

7. A base according to claim 1 further comprising panels of refractory insulating material which adapt the cross-sectional shape of the base to the profile of the tunnel in which the kiln car is to travel.

8. A base according to claim 7 wherein said panels of refractory insulating material are supported, at least in part, by said bats.

9. A base according to claim 1 wherein said bats are provided in said vertically spaced pillars so as to define two of said laterally projecting baffles in vertically spaced relation.

10. A light weight refractory base for a kiln car, said kiln car comprising a plurality of upright pillars supported on a multi-wheeled metal trolley, said refractory base comprising:

a hollow, double wall structure, said structure comprising spaced apart inner and outer walls, said inner and outer walls comprising a plurality of vertically extending wall plates;

said wall plates provided in horizontally spaced apart pairs disposed between adjacent pairs of said upright pillars thereby defining the periphery of said base;

said hollow, double wall structure filled with a high temperature refractory insulating material;

said refractory base further comprising a laterally projecting radiant heat seal baffle, and baffle disposed around said periphery, said baffle comprising a plurality of substantially flat, horizontally extending ceramic bats, said bats provided between adjacent pairs of said pillars, said wall plates supporting said bats; and said bats comprising respective grooves in which edges of said wall plates are received.

* * * * *